US006092404A

United States Patent [19]

Chhatwal

[11] Patent Number: 6,092,404

[45] Date of Patent: Jul. 25, 2000

[54] ELECTRONICALLY ACTUATED CARGO DOOR LOCK ASSEMBLY

[75] Inventor: Kn Singh Chhatwal, Melbourne, Fla.

[73] Assignee: Intellikey Corporation, Melbourne, Fla.

[21] Appl. No.: 09/088,468

[22] Filed: Jun. 1, 1998

Related U.S. Application Data

[60] Provisional application No. 60/048,123, May 30, 1997, and provisional application No. 60/047,377, Jun. 2, 1997.

[51] Int. Cl.[7] ..... E05B 49/00

[52] U.S. Cl. ..... 70/278.1; 70/423

[58] Field of Search ..... 70/423, 427, 431, 70/447, 448, 278.1–278.3, 279.1–283.1

[56] References Cited

U.S. PATENT DOCUMENTS

| | | | |
|---|---|---|---|
| 3,685,036 | 8/1972 | Torok | 70/431 |
| 4,038,846 | 8/1977 | Klann | 70/278.1 X |
| 4,044,579 | 8/1977 | Le Bel | 70/427 |
| 4,083,424 | 4/1978 | Von Den Stemmen et al. | 70/278.1 X |
| 4,506,527 | 3/1985 | Grill | 70/14 |
| 4,750,197 | 6/1988 | Denekamp et al. | 379/58 |
| 4,884,424 | 12/1989 | Meyer | 70/427 |
| 4,967,305 | 10/1990 | Murrer et al. | 70/278.1 X |
| 5,168,258 | 12/1992 | Radke | 70/54 |
| 5,321,963 | 6/1994 | Goldman | 70/278.1 |
| 5,337,588 | 8/1994 | Chhatwal | 70/278 |
| 5,437,174 | 8/1995 | Aydin | 70/150 |
| 5,540,069 | 7/1996 | Muller et al. | 70/278.2 |
| 5,648,763 | 7/1997 | Long | 340/825.49 |
| 5,670,940 | 9/1997 | Holcomb et al. | 70/431 |
| 5,686,899 | 11/1997 | Hosmer | 70/278.1 X |
| 5,755,126 | 5/1998 | Lanigan et al. | 70/278.1 X |
| 5,758,529 | 6/1998 | Chhatwal | 70/423 |
| 5,790,034 | 8/1998 | Khoury | 70/278.1 X |
| 5,815,084 | 9/1998 | Lavelle et al. | 70/278.1 X |
| 5,841,347 | 11/1998 | Kim | 70/278.1 X |
| 5,841,637 | 11/1998 | Chhatwal | 70/278 |
| 5,862,693 | 1/1999 | Myers et al. | 70/278.1 |
| 5,894,277 | 4/1999 | Keskin et al. | 70/278.1 X |
| 5,923,264 | 7/1999 | Lavele et al. | 70/278.1 X |

*Primary Examiner*—Suzanne Dino Barrett
*Attorney, Agent, or Firm*—Charles E. Wands

[57] ABSTRACT

An electronic lock housing assembly provides a lock retrofit for a transportation industry-standard cargo door lock assembly. The electronic lock assembly is configured to protect the electronic components of the lock from impact, moisture and foreign matter. The exterior housing retains an electronic lock cylinder and its cam assembly at the exterior of truck door, so as to engage the rotatable lever of a standard mechanical door latch assembly. The interior housing retains the lock's electronic circuitry directly behind the exterior housing on the opposite, interior side of the door, so as to facilitate electrical interconnection through a mechanically shielded channel in the door.

8 Claims, 7 Drawing Sheets

ELECTRONICALLY ACTUATED CARGO DOOR LOCK ASSEMBLY

CROSS-REFERENCE TO RELATED APPLICATION

The present application claims the benefit of provisional U.S. patent application Ser. No. 60/048,123, filed May 30, 1997 and provisional U.S. patent application Ser. No. 60/047,377, filed Jun. 2, 1997, each being entitled: "Site Verification Access Control," assigned to the assignee of the present application, and the disclosures of which are incorporated herein. In addition, the present application relates to subject matter disclosed in co-pending U.S. patent application Ser. No. 09/088,467, filed Jun. 1, 1998, filed coincidentally herewith, entitled: "Access Control System for Mobile Platform Using Electronic Key-Embedded Location Verification Data," by M. Mellen et al (hereinafter referred to as the '467 application), assigned to the assignee of the present application and the disclosure of which is incorporated herein.

FIELD OF THE INVENTION

The present invention is directed to an electronically actuated lock assembly for a cargo container, such as may be conveyed by a vehicle (e.g., aircraft, trailer truck and the like), and is particularly directed to a composite exterior—interior assembly that configured to secure and controllably provide access to the container by means of a physically protected electronic lock, which is unlocked by means of an associated electronic key.

BACKGROUND OF THE INVENTION

One of the most prevalent of what are often (erroneously) referred to 'victimless' crimes is cargo theft. Worldwide industry theft losses for cargo theft in 1995 were approximately $470 billion, and an additional $400 billion was lost to a multitude of cunning and deceptive fraud schemes. Between hijackings and internal fraud, the cost to business has reached such epidemic proportions, that the insurance industry has estimated that cargo theft losses now account for $150 of the retail price of every personal computer. As a consequence, insurance premiums and deductibles are rising at an alarming rate. While insurance company payouts can replace stolen goods, the loss of business from clients forced to buy from someone else might never be replaced. Also, even though enforcement agencies have begun forming task forces to deal with the problem, most of their responses have been reactive rather than proactive; law enforcement and private industry have realized that they must work together to solve the problem.

For this purpose, a very basic procedure has been to simply lock the doors of cargo containers and vehicles; however, such locking of truck/cargo carriers has not provided adequate protection, as industry experts point out as much as 80% of cargo theft is the result of insiders with keys to the truck/carrier storage units. It has been concluded that the only effective measure to secure cargo is to employ a measure that will assure that the truck or carried storage unit cannot be opened between its departure location and its intended destination.

One proposal to address this problem, described in the U.S. Pat. to Long, No. 5,648,763, is to equip the cargo container with a geographical position detection unit (such as a Global Positioning System (GPS)-based unit) that is directly connected to the locking mechanism for the container. The geographical position detection unit functions to maintain the security access control system for the container (a solenoid-driven lock) in a locked condition, until it detects that the container has arrived at its intended destination. At this point, the geographical position detection unit issues an unlock signal to the locking mechanism and allow access to the container.

A fundamental shortcoming with this approach is the fact that the security access control system and its associated geographical position detection equipment (such as a Global Positioning System (GPS)-based unit), which may typically be installed in or adjacent to the cab of a truck, or within the container proper where the cargo is stored, is directly linked with the hardware of the mechanical locking unit for the cargo container doors at the rear of the truck.

The fact that the two are directly linked through or along the confines of the truck where cargo is stored, and the substantial physical separation therebetween creates the potential for damage or compromise of the control link between the security access control unit and the lock. Moreover, all of the security access control information, including the critical geographical location information, is programmed into the security access control system. Since the security access control system is resident in equipment permanently installed in the container/vehicle, programming the geographical location information must be physically carried out 'in the truck'.

Advantageously, the invention described in the above-referenced co-pending '467 application substantially improves upon this patented system—providing additional security and functionality—by means of a programmable electronic lock, which can be unlocked only by an electronic key that has been programmed with geographical location data representative of the destination site of the cargo container. Preferably, the electronic lock and key are of the type described in U.S. Pat. Nos. 5,337,588 and 5,625,349 (hereinafter referred to as the '588 and '349 patents, respectively), each containing its own individually programmable control processor, and employing encrypted, scrambled (opto-electronic) communications for increased security.

Once the mobile platform has arrived at its destination site, the previously programmed electronic key is inserted into a location verification comparator unit, such as one employing a GPS receiver for the mobile platform. If the two sets of geographical location data match, the key is enabled for a prescribed interval of time. Otherwise the key remains disabled and the contents of the container remain secure. The key may then be inserted into the programmable electronic lock, which reads the key to determine whether it has been enabled. If the key is enabled, the lock can be unlocked and thereby provide access to the container.

Unfortunately, transportation industry-standard cargo door lock assemblies, such as a standard J-hook assembly for a roll-up rear cargo door, as a non-limiting example, are not configured to accommodate an electronic lock, including that described in the above-referenced '588 and '349 patents. As a consequence, either a completely new locking mechanism design, or some form of retrofit, is required. Because of the generally universal acceptance by and familiarity of transportation personnel with currently employed cargo door lock assemblies, a retrofit of the locking assemblies currently in use would be preferred. In doing so however, care must be taken to protect the electronic components of the lock from impact, moisture and foreign matter that is present both outside and inside the container.

SUMMARY OF THE INVENTION

In accordance with the present invention, this objective is successfully addressed by an electronic lock assembly having an exterior housing that retains and protects an electronic lock cylinder and associated cam assembly at the exterior of the container closure (e.g., truck door), that readily engages the rotatable lever of a standard door latch assembly. An interior housing is mounted to the opposite side of the door, and retains and protects the electronic circuitry that controls the operation of the lock. This composite housing assembly is configured to be employable with a variety of transportation industry standard type closures, such as a roll-up rear door, a hinged side door, or swing-hinged rear doors, customarily used with cargo storage containers.

The exterior housing portion of the lock assembly has a hollow body that is sealed against the door by means of a gasket that is sized and shaped to conform with a body flange and the interior walls of the cavity. The cavity is sized to retain and permit rotation of a pawl and rotatable lever of a standard mechanical door latch, which engages an L-catch, as the distal end of a latch bar engages the top surface of the body. The lever is controlled by a pin affixed to the lock cam. The front wall of the exterior housing body has a generally circular aperture that is sized to receive the lock cylinder, which is fixed within the housing cavity by means of a mounting bracket. A hinged front cover and a gasket retained thereby protects the front exterior portion of the electronic lock against moisture, foreign matter and impact by objects.

The interior housing assembly includes an interior escutcheon configured housing, which includes a metallic plate sub-assembly, that supports a circuit board of the lock's electronic circuitry. The electronic circuitry is powered by a battery pack, clip-mounted to the metallic plate adjacent to the circuit board. Opposite ends of the plate are configured to receive and retain a protective escutcheon cover. The escutcheon configured interior housing is secured via a sealing gasket with the interior surface of the door directly behind the exterior housing portion of the lock assembly. The gasket includes a slot that accommodates an electrical cable from the circuit board through a hole in the door to the lock cylinder.

In order to protect the interior escutcheon configured interior housing from damage that may be caused by cargo stored within the container, a relatively robust outer metallic escutcheon cover is mounted to the interior door surface, so as to surround the interior escutcheon cover. An upper end of the outer metallic escutcheon cover is slanted, allow cargo that may come in contact with the interior housing assembly, as when the door is raised from its closed position, to be deflected and not block the door, or damage the lock circuitry housing. The outer escutcheon cover is sealed against the door by a gasket that conforms with the perimeter thickness of the outer escutcheon cover. An intermediate cushioning pad is inserted between the outer escutcheon cover and the inner escutcheon cover, to dampen vibrations and further insulate the lock electronics from the surrounding container environment.

DETAILED DESCRIPTION

Figure 1:
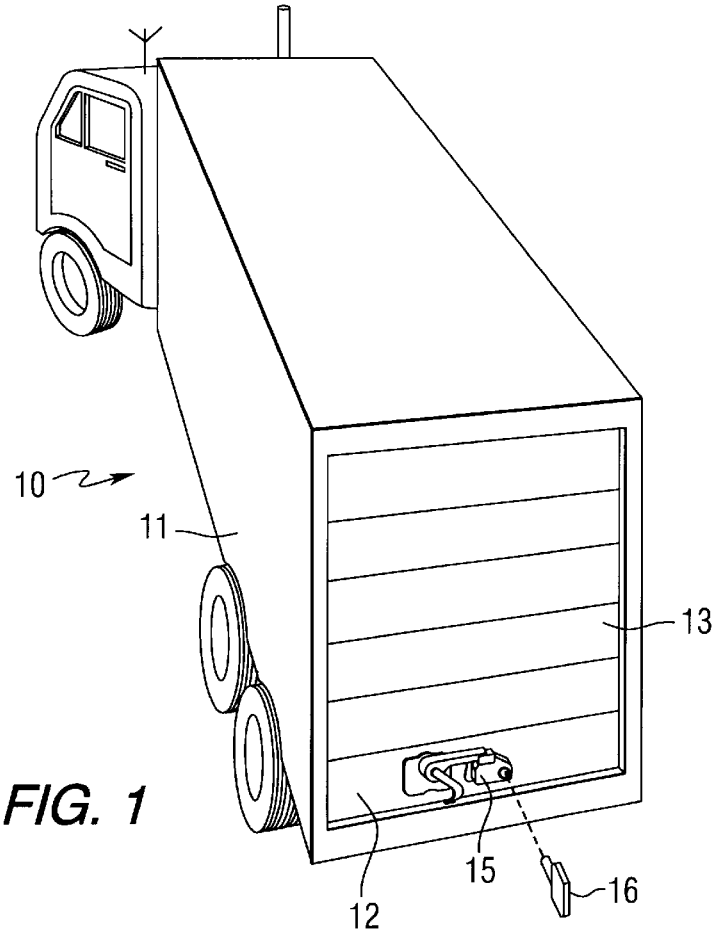
FIG. 1 illustrates a mobile transportation platform (trailer truck) in which the electronically actuated cargo door lock assembly of the present invention may be installed.

For purposes of providing a practical, but nonlimiting example, FIG. 1 diagrammatically illustrates a tractor trailer truck 10, which transports a container 11, with which the electronic lock-based latching assembly of the present invention may be used. It is to be understood however, that the platform/container with which the invention may be employed could be any of a variety of ground, marine or air-based units.

In the illustrated example, access to the tractor trailer cargo container 11 may be provided by conventional side or rear latchable and lockable doors, such as the illustrated roll-up rear door 12, one or more hinged side doors, or hinged rear doors, as customarily used with cargo storage containers. The electronic lock-controlled latch assembly mechanism is shown at 15 and is operated by an electronic key 16.

ELECTRONIC LOCK ASSEMBLY FOR ROLL-UP DOOR (FIGS. 2–18)

Figure 2:
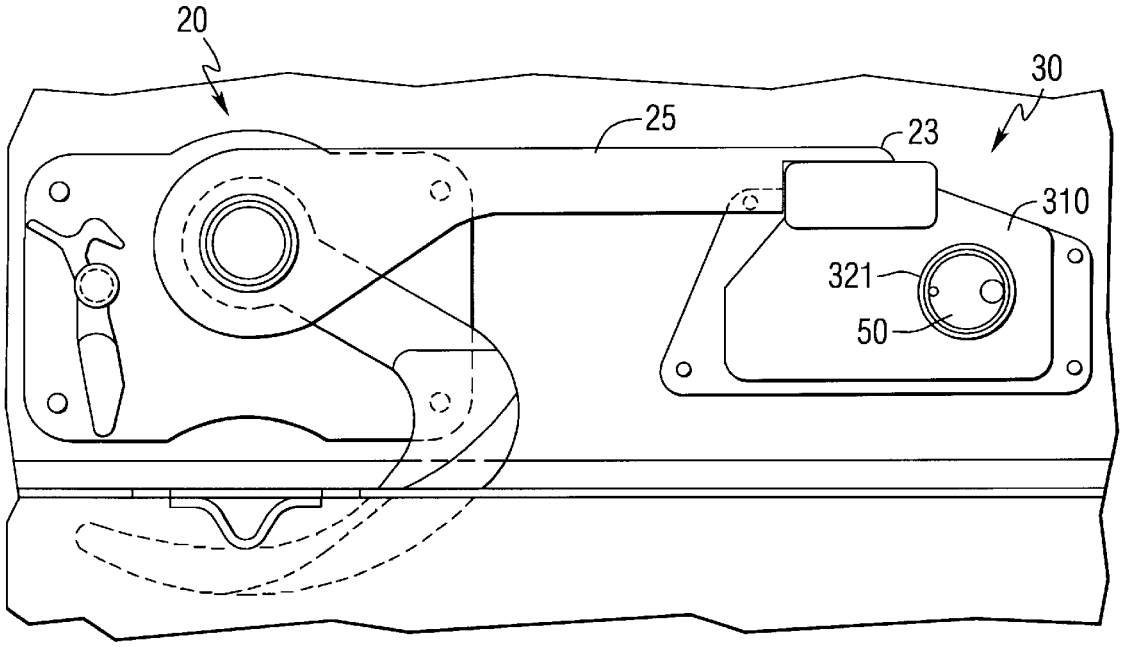
FIGS. 2 and 3 are respective diagrammatic front and rear views of the exterior housing portion of the electronically actuated cargo door lock assembly of the present invention.
Figure 3:
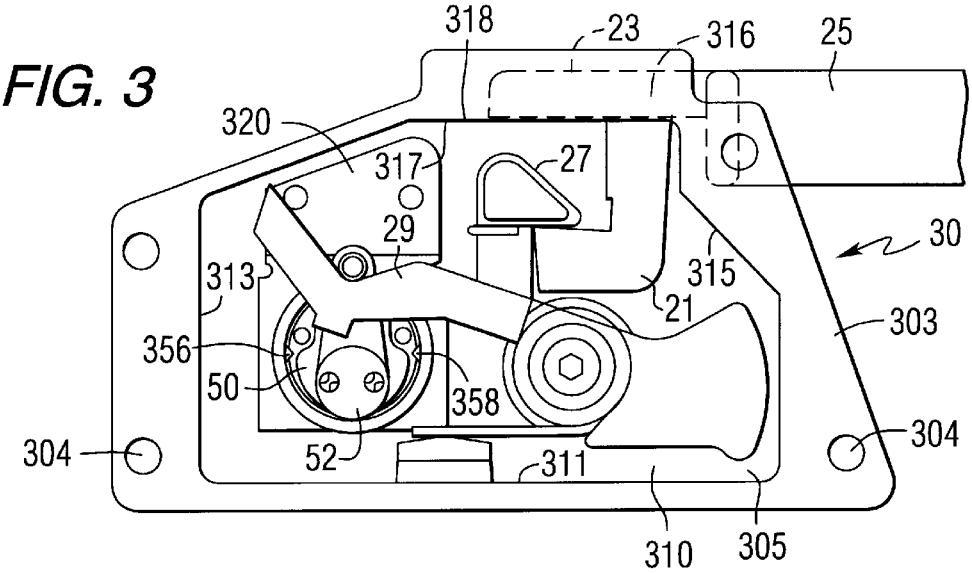

In accordance with a first embodiment, the electronically actuated cargo lock assembly of the invention is intended for use with a J-hook type of door latch, that is customarily used to secure a roll-up door, and is configured to accommodate a generally cylindrical electronic lock of the type described in the '349 and '588 patents. As shown in FIGS. 2 and 3, the configuration and operation of a standard J-hook latch assembly 20, and the engagement of an L-catch 21 at the distal end 23 of a main locking bar 25 with the pawl 27 of a rotatable lever 29 remains unchanged. What is added by the present invention is an exterior housing assembly 30, in which an electronically actuated lock is retained, and an associated interior housing assembly 40, in which the electronic circuitry for controlling the operation of the lock is mounted.

Figure 4:
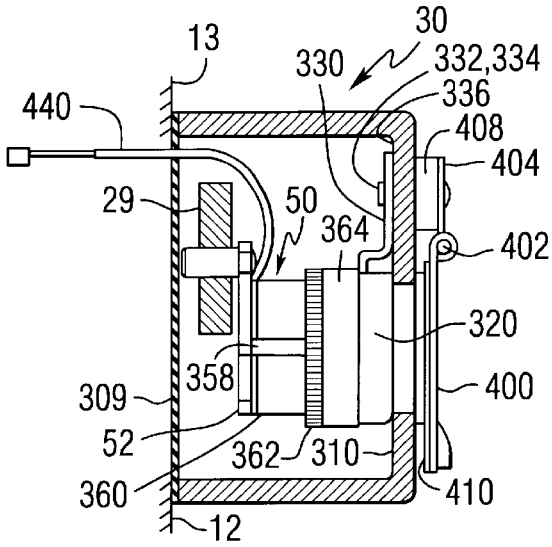
FIG. 4 is a diagrammatic side view of the exterior housing portion of the lock assembly of FIGS. 2 and 3.
Figure 5:
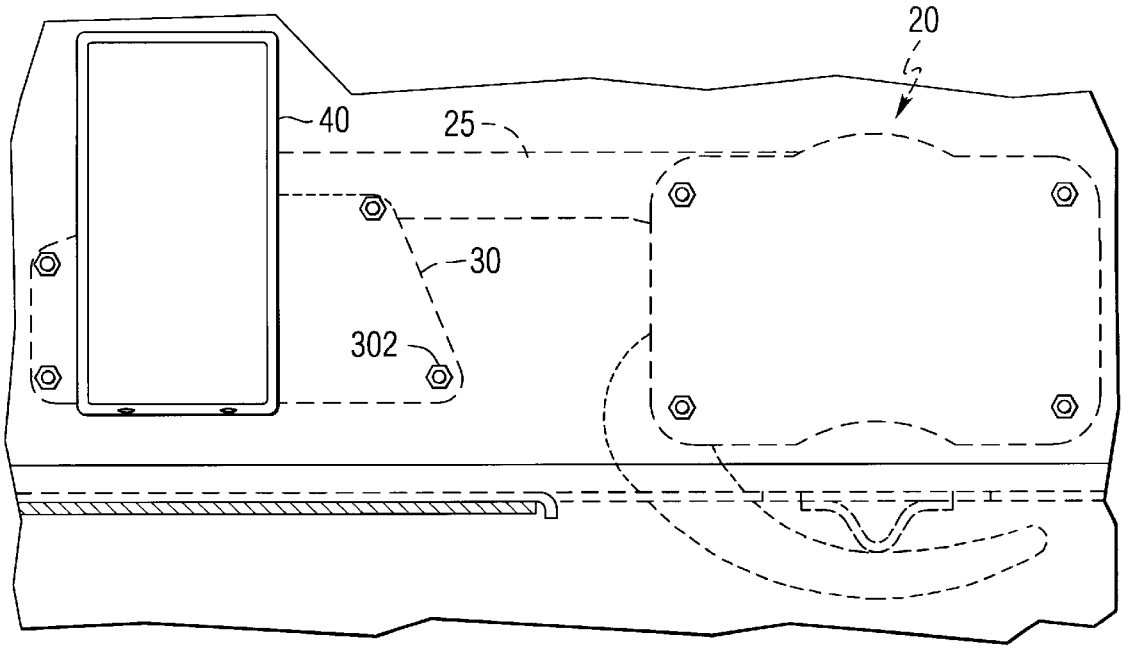
FIG. 5 is a diagrammatic rear view of the electronically actuated cargo door lock assembly of the present invention.

In particular, as shown in FIGS. 2–4, the exterior housing assembly 30 is configured to accommodate and protect a generally cylindrically configured electronic lock cylinder 50 and associated cam assembly 52 at the exterior surface 13 of the container door 12, so that the cam assembly may readily engage the rotatable lever 29 of the J-hook latch assembly. As shown in FIG. 5, the interior housing assembly 40 is mounted to the opposite, interior side 14 of the door, and serves to house and protect electronic lock circuitry that controls the operation of the cylindrical lock 50.

Figure 6:
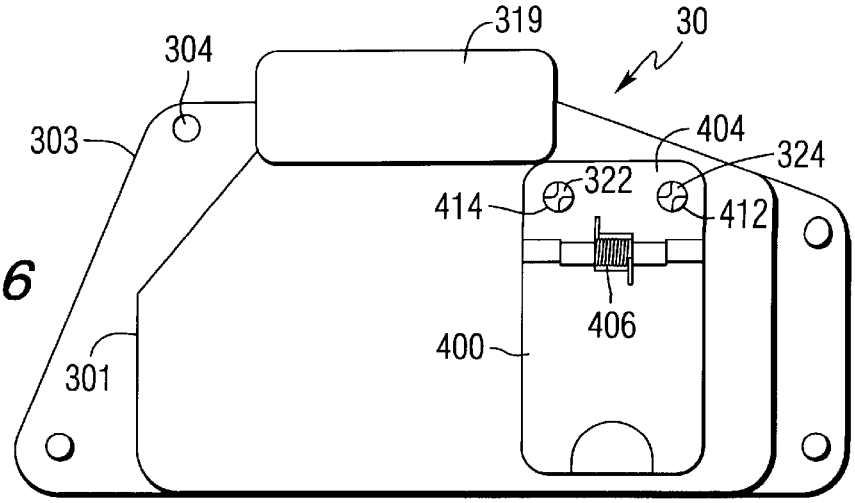
FIG. 6 a diagrammatic front view of the exterior housing portion of the lock assembly of FIGS. 2 and 3.
Figure 7:
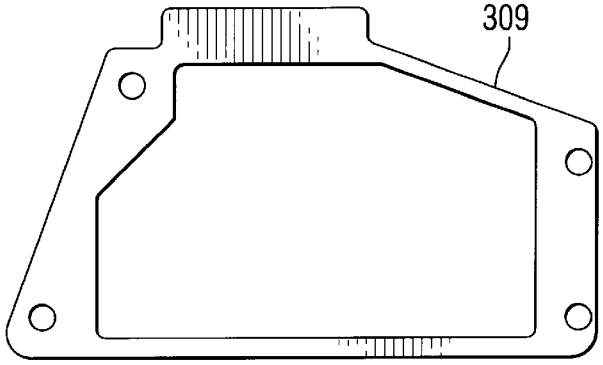
FIG. 7 shows the configuration of a gasket for sealing the exterior housing portion of the lock assembly of the invention against a door.

As shown in FIGS. 3, 4 and 6, the exterior housing assembly 30 has a generally rectilinear hollow body 301 and a surrounding mounting flange 303. The body 301 has an interior cavity 305 that is bounded by a front wall 310, bottom wall 311, side walls 313 and 315, and a top wall 317. A rear wall of the housing assembly is provided by the door upon which the housing assembly is mounted (e.g., by way of screws 302 through mounting holes 304 in the flange 303). In order to seal the body 301 against the door, a flat gasket 309 of neoprene or other suitable rugged, water impermeable material, is sized and shaped to conform with the outer perimeter of flange 303 and the interior walls of the interior cavity 305, as shown in FIG. 7.

The interior cavity 305 of the exterior housing assembly body 301 is sized to accommodate and permit rotation of the pawl 27 and the rotatable lever 29 for engagement and release of the L-catch 21. A slot or opening 316 is formed in the top wall 317 of the body 301 and is sized to allow entry of the L-catch 21 into the cavity 305, as the distal end 23 of the main bar 25 comes to rest upon the top exterior surface 318 of the body 301. A side guard plate 319 extends upwardly from the front wall 310 adjacent to the top exterior surface 318 of the exterior housing assembly body 301.

Figure 8:
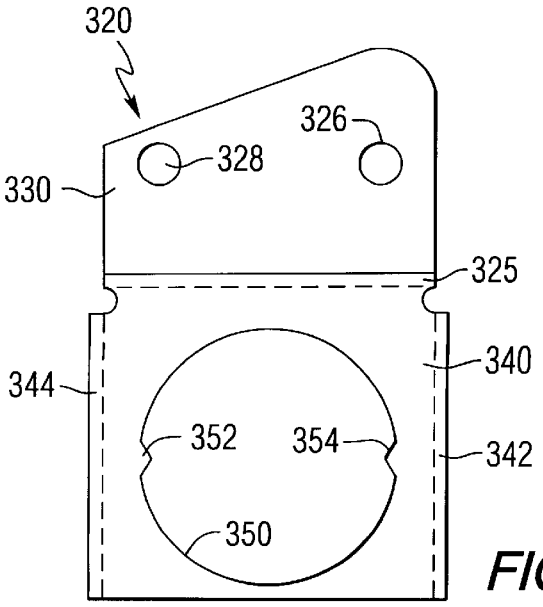
FIGS. 8 and 9 are respective front and side views of a lock cylinder mounting bracket.
Figure 9:
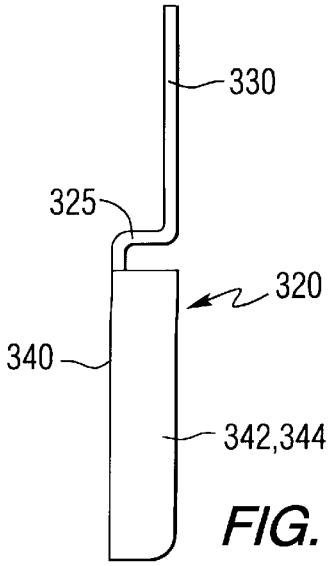

As shown in FIG. 2, the front wall 310 of the exterior housing assembly 30 has a generally circular aperture 321 that is sized to receive the generally cylindrically configured electronic lock cylinder 50. In order to fixedly mount the lock cylinder 50 within the interior cavity 305 of the body 301, a generally L-shaped mounting bracket 320, shown in detail in FIGS. 8 and 9, is mounted by way of fasteners 322 and 324 (such as rivets and the like), passing through holes 326 and 328 in a first plate portion 330 of the bracket 320. Fasteners 322 and 324 pass through further holes in the wall 310, so that the first plate portion 330 may be retained against the interior surface 336 of the exterior housing front wall 310.

A second plate portion 340 of the bracket 320 is offset from the first plate portion 330 by a generally L-shaped bend 325 in the bracket 320. A pair of sidewalls 342 and 344 extend from side edges 346 and 348 of the second plate portion 340 of the bracket to a depth of the first plate portion 330, so as to provide offset support for the second plate portion 340 against the interior surface 336 of the front wall 310. A generally circular aperture 350 having a pair of diametrically opposed ears 352 and 354 is formed in the second plate portion 340 of the bracket 320.

The generally circular aperture 350 in the second plate portion 340 of the bracket is sized to receive the cylindrical body of the electronic lock, with the ears 352 and 354 coinciding with a pair of longitudinal grooves 356 and 358 along a threaded exterior cylindrical wall portion 360 of the lock cylinder 50, so as to prevent rotation of the lock cylinder in its installed position. To securely retain the lock cylinder in place, a threaded ring 362 is screwed onto the threaded exterior cylindrical wall portion 360 of the lock cylinder 50, so that it engages a generally annular spacer 364 against the second plate portion 340 of the bracket 320.

Figure 10:
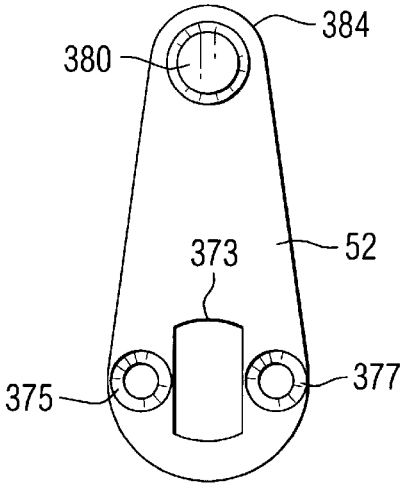
FIGS. 10 and 11 are respective front and side views of a lock cylinder cam assembly.
Figure 11:
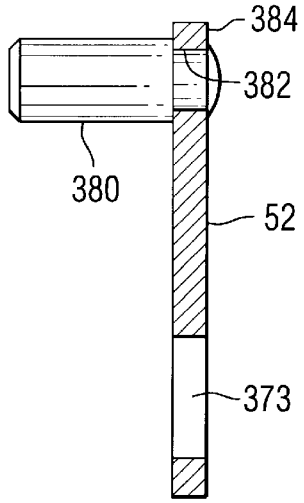

The lock's cam assembly 52 is shown in detail in FIGS. 10 and 11, as comprising a generally elongate oval cam member 371 having a keyed slot 373 that engages a corresponding key projection of the rotational shaft of the lock cylinder 50. The cam member 371 is affixed to the lock cylinder shaft by screws that pass through countersunk bores 375 and 377 of the cam member. A pin 380 for engaging the lever 29 of the latch assembly 20 is retained in an aperture 382 at the distal end 384 of the cam 371.

In order to protect the front exterior portion of the electronic lock cylinder 50 against moisture, foreign matter and impact by objects, a hinged front cover 400 is arranged to rotate about a shaft 402 that is parallel to the front wall 310 of the housing 30. For this purpose, a hinge plate 404, which is configured to receive the shaft 402, is coupled to a bias spring 406 surrounding the shaft 402, and is affixed to the front wall 310 by way of a stand-off 408.

The thickness of the stand-off 408 is sized so that a protective neoprene gasket 410 that is mounted to the inside of the front cover 400 will be urged in a firm sealing engagement with the front face of the electronic lock 50, when the hinged front cover 400 is biased into its closed position by the spring 406. The hinge plate 404 has apertures 412 and 414 that are aligned with the holes in the first plate portion 330 of the bracket 320 and holes through the front wall 310 of the housing body 301, so that the bracket 320 and the front cover may be affixed to the housing by common mounting fasteners (e.g., rivets) 322 and 324, referenced above.

The interior housing assembly 40, which is configured to house and protect the electronic lock's control circuitry, preferably includes an interior escutcheon configured housing of the type disclosed in my co-pending U.S. Pat. No. 5,841,637 (hereinafter referred to as the '637 patent application), filed Mar. 25, 1996, entitled: "ED-Protective Housing for Electronically Operated Lock," assigned to the assignee of the present application and the disclosure of which is incorporated herein.

As detailed in the '637 patent application, such an escutcheon configured housing includes a conductive (metallic) plate sub-assembly, that is employed as a support structure for a circuit board of the lock's electronic circuitry and as a wall of the protective housing. The circuit board contains a ground conductor layer which is electrically connected to the metallic plate via conductive mounting standoffs therebetween. The electronic circuitry of the lock is powered by way of a battery pack, that is clip-mounted to the metallic plate adjacent to the circuit board.

Figure 12:
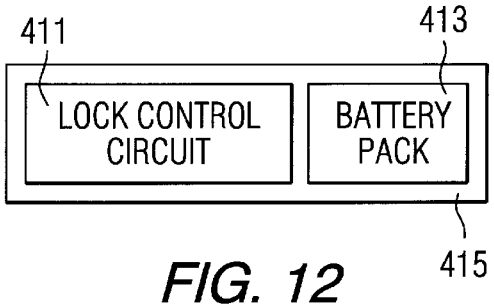
FIG. 12 diagrammatically illustrates a circuit board and associated battery pack mounted end-to-end.
Figure 14:
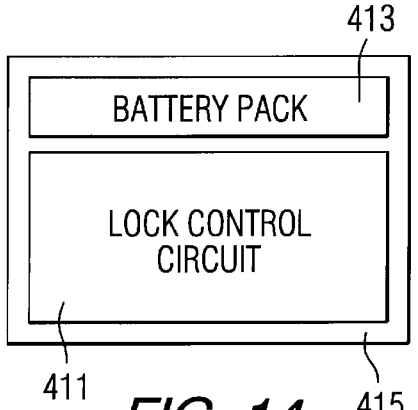
FIG. 14 diagrammatically illustrates a circuit board and associated battery pack mounted side-by-side.
Figure 13:
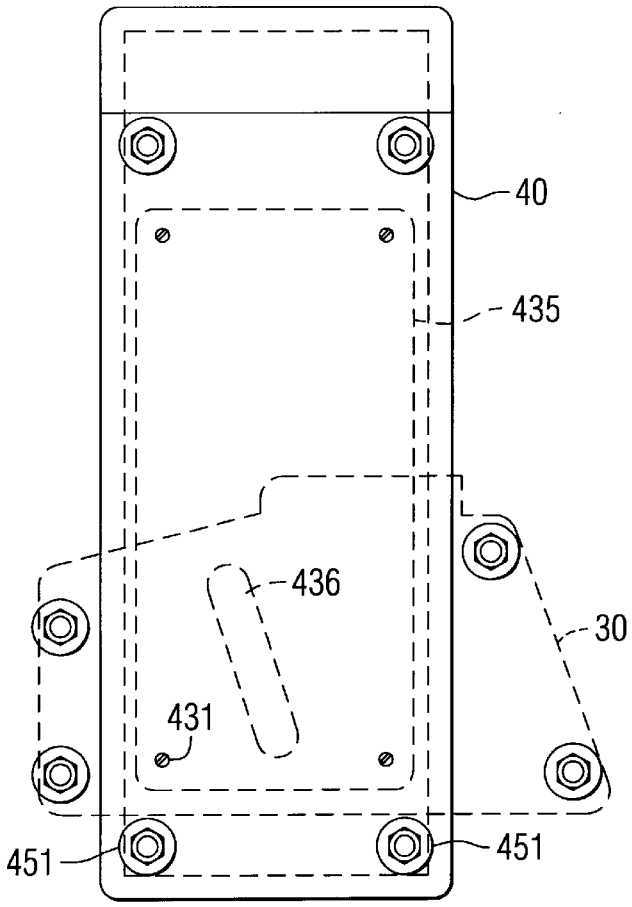
FIG. 13 shows the mutual projection of the exterior and interior door-mounted lock assembly housings of the invention.

This configuration is diagrammatically illustrated in FIG. 12, which shows a circuit board 411 and an associated battery pack 413, that are mounted end-to-end (adjacent to one another along the lengthwise direction of the metallic plate 415), in order to conform with the narrowness of the door environment of interest. Alternatively, for a change in relative length/width dimensions, as in the case of the exterior and interior door-mounted lock assembly housings of the present embodiment of the invention shown in FIG. 13, the battery pack 413 may be placed at the side of the circuit board 411 upon which lock control circuitry 60 for operating the lock cycliner 50 is mounted, as shown diagrammatically in FIG. 14.

Figure 15:
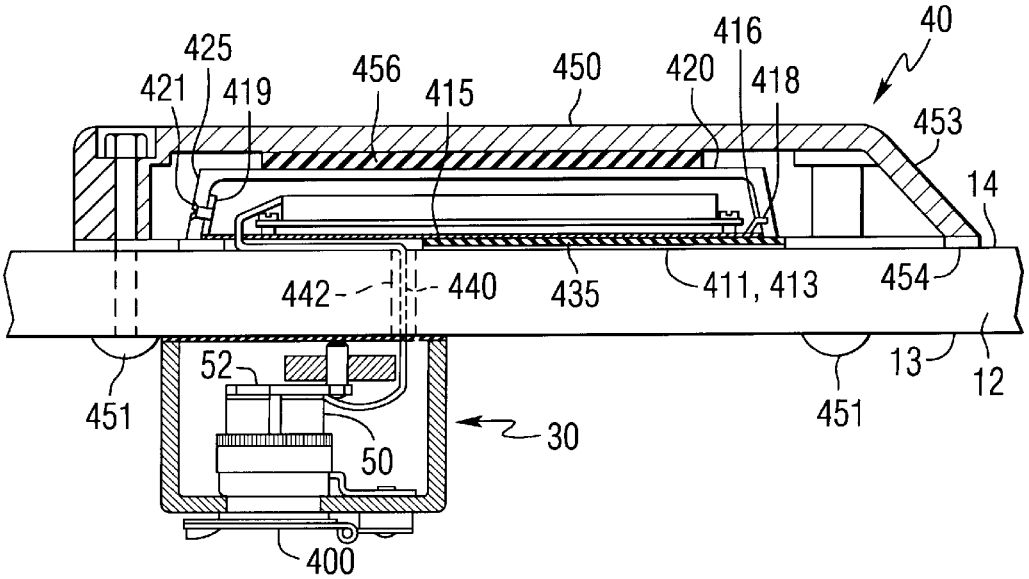
FIG. 15 is a diagrammatic side view of an interior escutcheon housing for the circuit board and associated battery pack of the lock control electronics of the invention.

As detailed in the '637 patent application, and as shown in the side view of FIG. 15, the metallic plate 415 has a generally L-shaped flange 416 at a first end of the plate that extends above and projects slightly beyond the end edge of the plate, allowing the flange 416 to fit within a corresponding slot or depression 418 within a first end of a protective escutcheon cover 420, which comprises a generally elongated, rectangularly shaped metallic casing. The second end edge of the metallic plate 415 includes a pair of tabs 419 which extend generally vertically from the plate surface, and contain tapped holes that are sized to be engaged by screws 421 insertable through holes in an end wall 425 of the escutcheon cover 420.

Figure 16:
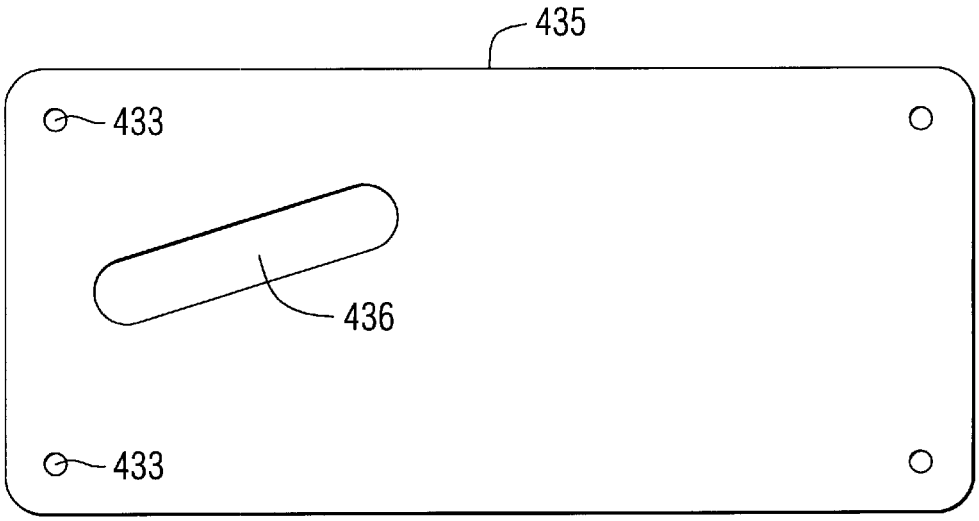
FIG. 16 shows the configuration of a gasket for sealing the interior escutcheon housing of FIG. 15 against a door.

The escutcheon configured interior housing 420 is secured to the interior surface 14 of the door 12 by means of fasteners (screws) 431, which pass through associated holes 433 in a neoprene sealing gasket 435, shown in detail in FIG. 16, that conforms with the generally rectangular shape of the metallic plate 415. The gasket 435 includes a slot 436, that is configured to accommodate the passage of an electrical cable set 440 from the lock control circuitry 60 of the circuit board 411 through a hole 442 in the door 12 to the lock cylinder 50. Advantageously, because the two housing portions 30 and 40 of the lock assembly of the invention are disposed in mutual projection on opposite sides of the door 12 (as shown FIG. 13), the electrical cable set 440 through the channel 442 through the door between the lock cyliner 50 and the lock control circuitry 60 is effectively continuously protected by a mechanical shielding barrier.

Figure 17:
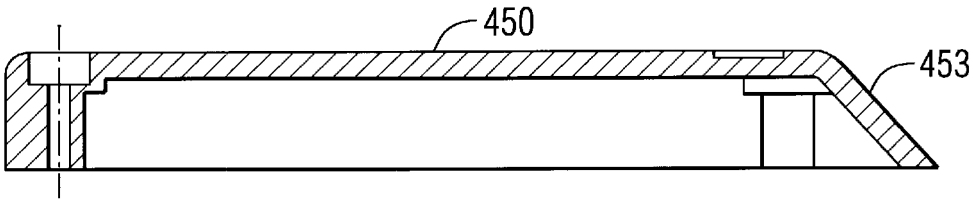
FIGS. 17 and 18 are respective side and bottom views of an exterior escutcheon housing for protecting the interior escutcheon housing of FIG. 15.
Figure 18:
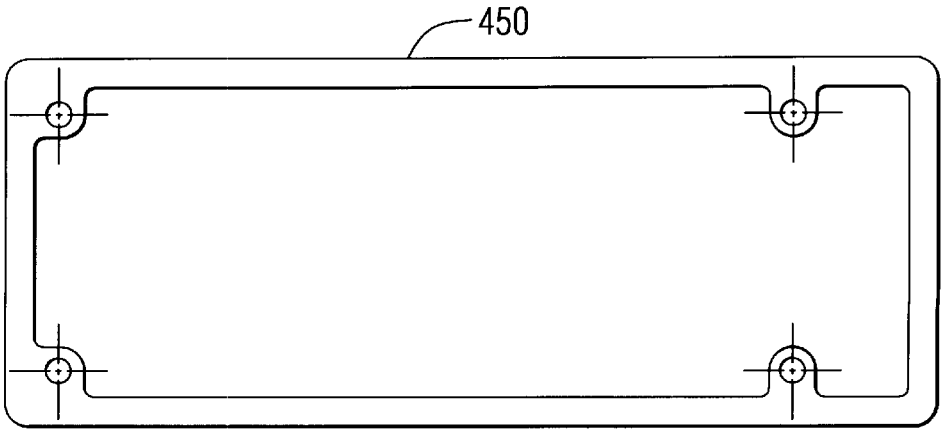

In order to protect the interior escutcheon configured interior housing 420 from possible damage due to impact by cargo stored within the container, a relatively robust (e.g., quarter inch thick) outer metallic escutcheon cover 450, shown in detail in FIGS. 17 and 18, is mounted to the interior door surface 14, e.g., by way of a set of carriage bolts 451 and associated retention nuts 452, so as to effectively surround the interior escutcheon cover 420. An upper end portion 453 of the outer metallic escutcheon cover 450 is slanted, so as to allow cargo that may come in contact with the interior housing assembly 40 (particularly when the door is being raised from its closed position), to be deflected and thereby not block movement of the door, or damage the interior escutcheon cover 420 and the lock circuitry it protects.

The outer escutcheon cover 450 is sealed against the door by means of an outer neoprene gasket 454 that conforms with the perimeter wall thickness of the outer escutcheon cover 450. In addition, an intermediate neoprene cushioning pad 456 is inserted between the outer escutcheon cover 450 and the inner escutcheon cover 420, so as to dampen vibrations and further insulate the lock electronics from the surrounding container environment.

ELECTRONIC LOCK ASSEMBLY FOR SIDE DOOR (FIGS. 19–20)

Figure 19:
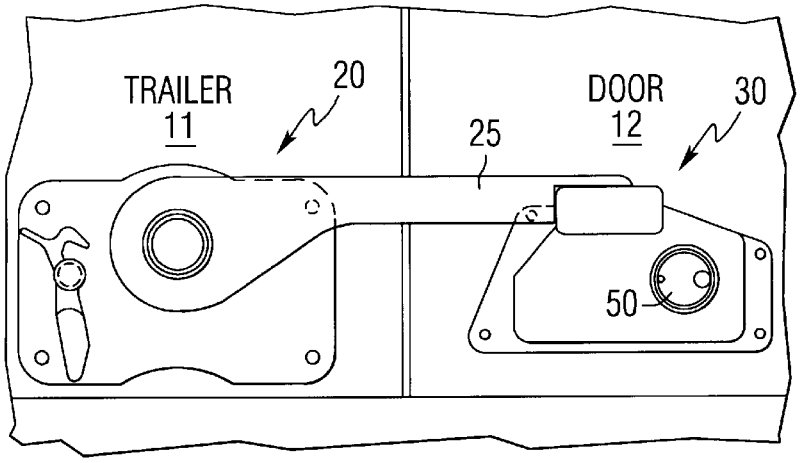
FIGS. 19 and 20 diagrammatically illustrate the use of the electronically actuated cargo lock assembly of the invention with a standard side door latch assembly.
Figure 20:
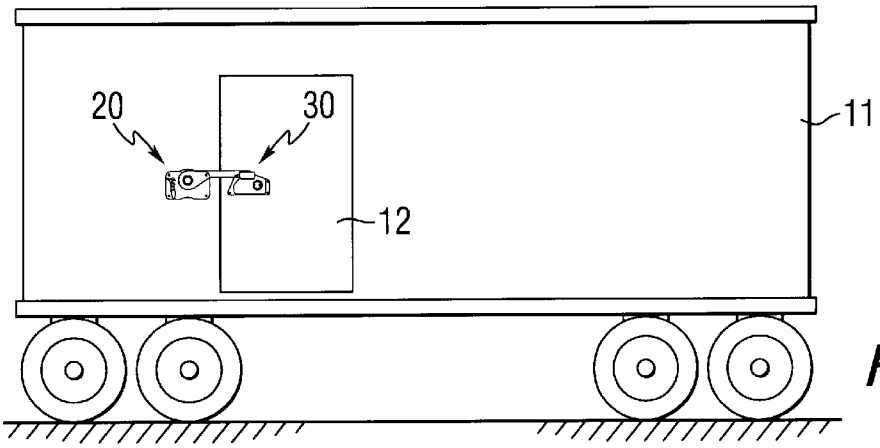

The manner in which the electronically actuated cargo lock assembly of the invention may be used with a standard side door latch assembly is diagrammatically illustrated in FIGS. 19 and 20. This embodiment has the same architecture described above with reference to FIGS. 2–18. The difference is the fact that a side door latch assembly (which latches at the side, rather than at a bottom catch plate, as shown in FIGS. 2 and 3, it has no J-hook.

ELECTRONIC LOCK ASSEMBLY FOR SWINGING DOORS (FIGS. 21–23)

Figure 22:
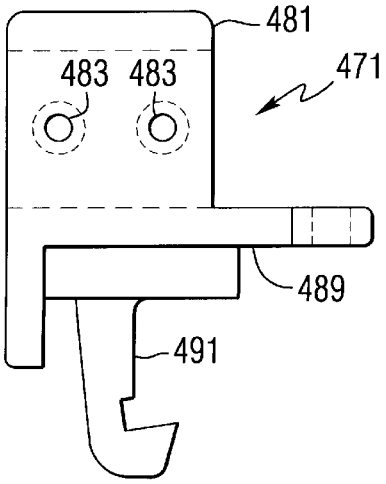
FIGS. 22 and 23 are respective side and end views of the L-catch bracket for use with the cargo lock assembly of FIG. 21.
Figure 23:
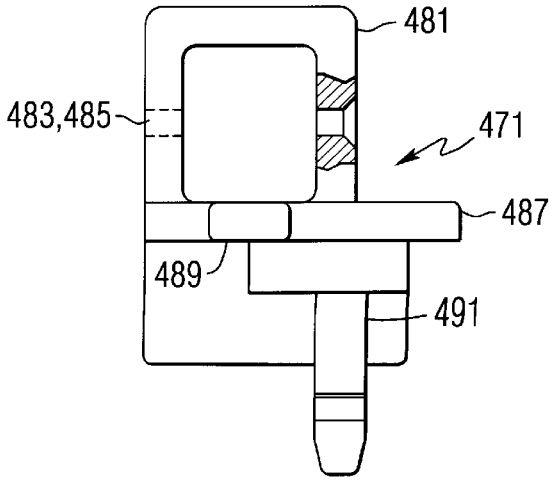
Figure 21:
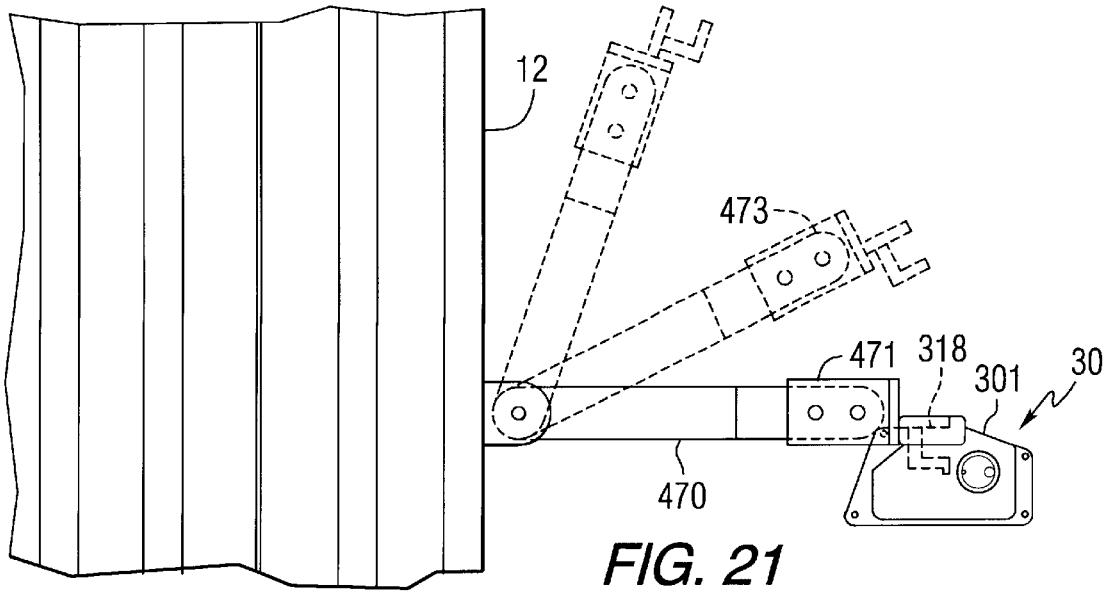
FIG. 21 diagrammatically illustrates the use of the electronically actuated cargo lock assembly of the invention with a standard swinging double rear door latch assembly.

The manner in which the electronically actuated cargo lock assembly of the invention may be used with a standard swinging double rear door latch assembly is diagrammatically illustrated in FIGS. 21–23. Like the second embodiment of FIGS. 19 and 20, this embodiment has the same architecture described above with reference to FIGS. 2–18. Differences are the fact the latch assembly has no J-hook, and the rotatable locking arm 470 has an L-catch bracket 471 (shown in detail in FIGS. 22 and 23) mounted at its distal end 473, and configured to rest upon the top exterior surface 318 of the body 301 of the exterior housing assembly 30, as described above with reference to the first embodiment.

As shown in the side view of FIG. 22 and the end view of FIG. 23, L-catch bracket 471 has a generally U-shaped hollow upper sleeve 481, that is sized to receive and be affixed (via screws passing through holes 483 and 485) to distal end 473 of rotatable locking arm 470. The generally U-shaped hollow upper sleeve 481 is integral with a generally flat plate 487 having a forward or nose end 489, beneath which extends an L-catch 491. As in the first embodiment, this configuration allows the L-catch 491 to readily engage the pawl of the rotatable lever of the door latch, as the forward end 489 of the bracket 471 comes to rest upon the top exterior surface 318 of the body 301 of the exterior housing assembly 30.

As will be appreciated from the foregoing description, the electronic lock housing assembly of the present invention provides a lock retrofit for a variety of transportation industry-standard cargo door lock assemblies, and is configured to protect the electronic components of the lock from impact, moisture and foreign matter that is typically present both outside and inside a standard truck trailer.

The exterior housing retains an electronic lock cylinder and its cam assembly at the exterior of truck door, so that it can readily engages the rotatable lever of a standard door latch assembly. The interior housing retains the lock's electronic circuitry directly behind the exterior housing on the opposite side of the door, so as to facilitate electrical interconnection within a mechanically shielded channel through the door.

While I have shown and described an embodiment in accordance with the present invention, it is to be understood that the same is not limited thereto but is susceptible to numerous changes and modifications as are known to a person skilled in the art, and I therefore do not wish to be limited to the details shown and described herein, but intend to cover all such changes and modifications as are obvious to one of ordinary skill in the art.

What is claimed:

1. An apparatus for electronically locking a latch of a container closure comprising:

an exterior housing assembly adapted to be mounted at an exterior region of said container closure, and retaining therein an electronically operated lock and a driven member thereof that is arranged to controllably engage and release said latch, said electronically operated lock being configured to be coupled with an electronic key that has been programmed with prescribed information representative of the ability of said electronic key to unlock said electronically operated lock; and an interior housing assembly adapted to be mounted to an interior region of said container closure and containing programmable electronic lock circuitry for controlling said electronically operated lock, said programmable electronic lock circuitry being programmable to be operated by said electronic key and thereby unlock said electronically operated lock, and wherein said interior housing assembly is adapted to be installed at an interior region of said container closure directly adjacent to said exterior housing assembly at said exterior region of said container closure, and includes an inner escutcheon, containing said programmable electronic lock circuitry, an outer escutcheon cover that surrounds said inner escutcheon, and cushioning material interposed between said outer escutcheon cover and said inner escutcheon, and being operative to dampen vibrations, and insulate said programmable electronic lock circuitry from its surrounding environment.

2. An apparatus according to claim 1, further including a gasket interposed between said inner escutcheon and said container closure.

3. An apparatus according to claim 1, wherein said outer escutcheon cover comprises a metallic outer escutcheon cover having a slanted surface portion that deflects objects that may come in contact with said interior housing assembly.

4. An apparatus according to claim 3, wherein said outer metallic escutcheon cover includes bores therethrough adjacent opposite ends of said inner escutcheon, and being configured to receive fasteners, which pass through associated apertures in said container closure and securely affix said outer metallic escutcheon cover to said interior region of said container closure.

5. An apparatus according to claim 1, wherein said latch includes a rotatable arm having an L-catch bracket at a distal end thereof, and configured to rest upon a top exterior surface of said exterior housing assembly, and thereby allow an L-catch of said L-catch bracket to engage said driven member of said electronically operated lock.

6. An apparatus according to claim 1, wherein said programmable electronic lock circuitry for controlling said programmable electronic lock is programmable to unlock said electronically operated lock, in response to said electronic key being programmed with geographical location data representative of a destination site of said container closure.

7. An apparatus, for electronically locking a latch of a container closure comprising:

an exterior housing assembly adapted to be mounted at an exterior region of said container closure, and retaining therein an electronically operated lock and a driven member thereof that is arranged to controllably engage and release said latch, said electronically operated lock being configured to be coupled with an electronic key that has been programmed with prescribed information representative of the ability of said electronic key to unlock said electronically operated lock; and an interior housing assembly adapted to be mounted to an interior region of said container closure and containing programmable electronic lock circuitry for controlling said electronically operated lock, said programmable electronic lock circuitry being programmable to be operated by said electronic key and thereby unlock said electronically operated lock, and wherein said latch includes a rotatable arm having an L-catch bracket at a distal end thereof, and configured to rest upon a top exterior surface of said exterior housing assembly, and thereby allow an L-catch of said L-catch bracket to engage said driven member of said electronically operated lock.

8. An apparatus, for electronically locking a latch of a container closure comprising:

an exterior housing assembly adapted to be mounted at an exterior region of said container closure, and retaining therein an electronically operated lock and a driven member thereof that is arranged to controllably engage and release said latch, said electronically operated lock being configured to be coupled with an electronic key that has been programmed with prescribed information representative of the ability of said electronic key to unlock said electronically operated lock; and an interior housing assembly adapted to be mounted to an interior region of said container closure and containing programmable electronic lock circuitry for controlling said electronically operated lock, said programmable electronic lock circuitry being programmable to be operated by said electronic key and thereby unlock said electronically operated lock, and wherein said programmable electronic lock circuitry for controlling said programmable electronic lock is operative to unlock said electronically operated lock, in response to said electronic key being programmed with geographical location data representative of a destination site of said container closure.

* * * * *